US006061499A

United States Patent [19]

Hlebovy

[11] Patent Number: 6,061,499

[45] Date of Patent: May 9, 2000

[54] COMPOSITE INSTANTANEOUS WATER HEATER

[75] Inventor: James C. Hlebovy, Chardon, Ohio

[73] Assignee: Structural North America, Chardon, Ohio

[21] Appl. No.: 09/048,526

[22] Filed: Mar. 26, 1998

Related U.S. Application Data

[60] Provisional application No. 60/042,893, Mar. 31, 1997.

[51] Int. Cl.[7] ..... F24H 1/10

[52] U.S. Cl. ..... 392/485; 392/465

[58] Field of Search ..... 392/485, 465, 392/449, 451, 453, 487, 444

[56] References Cited

U.S. PATENT DOCUMENTS

| | | | |
|---|---|---|---|
| 1,718,866 | 6/1929 | Macy | 392/449 |
| 2,718,583 | 9/1955 | Noland et al. | 392/458 |
| 2,877,335 | 3/1959 | Relf | 392/451 |
| 3,207,358 | 9/1965 | Fliss | 219/385 |
| 3,617,700 | 11/1971 | Hooper | 392/487 |
| 4,477,399 | 10/1984 | Tilton | 264/45.2 |
| 4,589,563 | 5/1986 | Born | 220/581 |
| 4,687,905 | 8/1987 | Cunningham et al. | 392/498 |
| 4,865,014 | 9/1989 | Nelson | 126/361 |
| 5,220,638 | 6/1993 | Moore et al. | 392/449 |

*Primary Examiner*—Teresa Walberg
*Assistant Examiner*—Thor S. Campbell
*Attorney, Agent, or Firm*—Pearne, Gordon, McCoy & Granger LLP

[57] ABSTRACT

An insulated composite hot water heater is disclosed. The heater comprises an inner plastic pressure vessel for storing and heating water. The pressure vessel has an access opening provided with a removable closure plate. A heat exchanger unit is provided within said pressure vessel and retained therein by the closure plate. An outer housing surrounds the inner plastic pressure vessel and a thermal insulating material is interposed between the vessel and the housing.

9 Claims, 4 Drawing Sheets

COMPOSITE INSTANTANEOUS WATER HEATER

This application claim priority benefit of U.S. Provisional Application No. 60/042,893 filed on Mar. 31, 1997.

BACKGROUND OF THE INVENTION

This invention relates to water heaters and, more particularly, to instantaneous small capacity water heaters which are adapted to serve closely adjacent appliances that consume or dispense hot water. Small capacity, rapid response water heaters that are positioned closely adjacent the unit to be served are economical in that they are well insulated and are not subject to heat loss through long reaches of copper tubing prior to delivery to the appliance or hot water dispenser as contrasted to large capacity water heaters which are intended to serve a number of locations from a single station. Existing instantaneous heaters are constructed of stainless or porcelain steel which are either subject to corrosion or are expensive. In either case the water heaters are not particularly attractive.

BRIEF DESCRIPTION OF THE INVENTION

This invention provides a lightweight, non-corrosive and attractive instantaneous water heater. According to this invention the water heater comprises an inner plastic pressure vessel for storing heated water. The pressure vessel has an access opening provided with a removable cover plate which mounts an electric resistance heating element so that the heating element may be mounted within the pressure vessel and retained therein by the closure fitting. An outer housing surrounds the inner plastic pressure vessel. A thermal insulating material such as a closed cell, foamed-in-place urethane is interposed between the inner plastic pressure vessel and the outer housing. The housing is provided with a removable closure cap so that access may be had to a space between the closure cap and the cover plate for servicing switching and thermostatic controls for the electric resistance heating element provided therein and for access to the electric resistance heater itself.

The pressure vessel employed in this invention utilizes a rotationally molded liner with aluminum flanges at the polar ends which are integrally molded into the rotationally molded liner according to the teachings of U.S. Pat. No. 4,705,768. The rotationally molded liner is filament wound with continuous epoxy-impregnated fiberglass for pressurized applications. The outer plastic housing maybe formed by either rotational molding or blow molding techniques and the typical material for the liner and the housing is polyethylene.

DETAILED DESCRIPTION OF THE INVENTION

Figures 1, 2, 3:
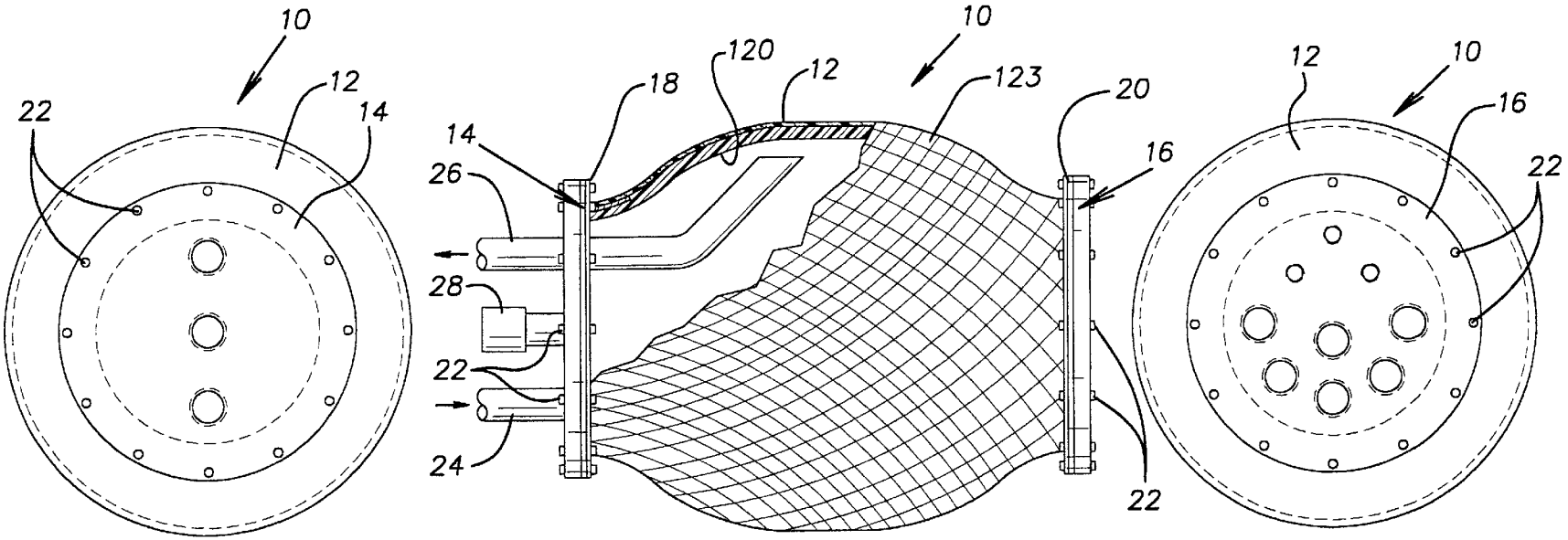
FIG. 1 is an elevational view of the inner plastic pressure vessel of this invention with a portion broken away to show details of construction.
FIG. 2 is an end view of the pressure vessel.
FIG. 3 is an opposite end view of the pressure vessel.

Referring now to the drawings and, particularly, to FIG. 1, there is illustrated an inner plastic pressure vessel 10 for storing and heating water. The pressure vessel 10 includes a polyethylene wall portion 12 which is filament wound with continuous epoxy-impregnated glass fiber for pressurized applications according to well known prior art techniques. The polyethylene wall is desirably rotationally molded according to the teachings of U.S. Pat. No. 4,705,468, the subject matter of which is incorporated herein by reference. Alternatively, the polyethylene wall 12 may be formed by blow molding techniques as set forth in U.S. Pat. No. 4,589,563, the subject matter of which is incorporated herein by reference.

The ends of the pressure vessel 10 are provided with metal cover plates 14 and 16 which are respectively mounted on metal flanges 18 and 20 by a plurality of bolts 22.

Figure 4:
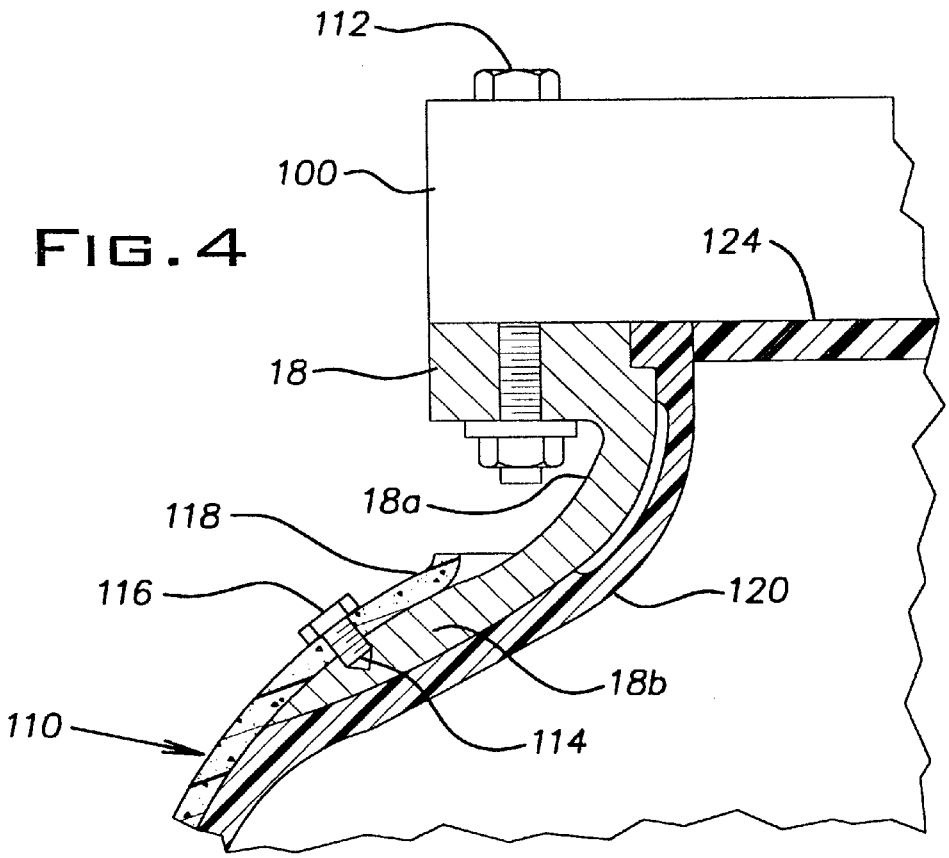
FIG. 4 is a fragmentary elevational view, partly in section, of a rotational casting mold mounting arrangement for producing the inner plastic pressure vessel of this invention.
Figure 5:
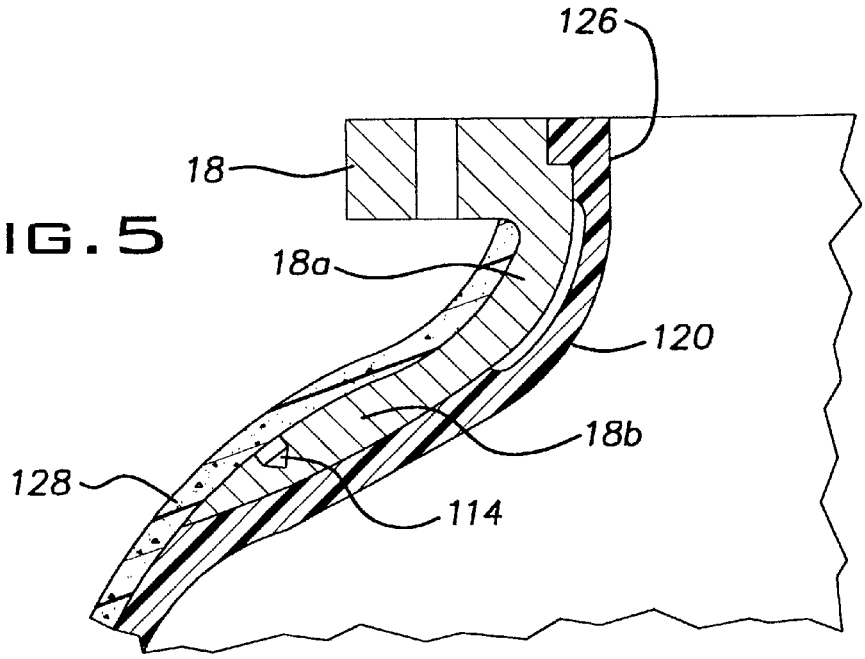
FIG. 5 is a fragmentary elevational view of the inner plastic pressure vessel of this invention.

Referring now to FIGS. 4 and 5, the inner plastic pressure vessel 10 may be molded in a rotational casting machine as set forth in detail in U.S. Pat. No. 4,705,468. As described in that patent, the molding apparatus comprises a mold arm assembly which includes upper and lower frame members (not shown). The frame members are rotated about a first axis. Mounting plates 100 are rotatably carried by each frame member and are driven to rotate about a second axis which is perpendicular to the first axis.

A rotational casting mold 110 is mounted between the mounting plates 100 by a plurality of blots 112 which extend, for example, from the mounting plates 100 through the flange 18. As may be seen in FIG. 4 the flange 18 has a cylindrical neck portion 18*a* provided with an annular tapered foot 18*b*. The tapered foot 18*b* is provided with a plurality of blind openings 114 therein which receive bolts 116 which pass through an upper rim portion 118 of the mold 110.

The pressure vessel is molded by placing a charge of powdered thermoplastic resin in the mold 110 and rotating the mold about orthogonal axes. Heat is supplied so that the resin is fused in an even layer having a predetermined thickness. The application of heat to the mold causes the resin to melt or fuse, and the rotation of the mold causes the liquid resin to uniformly coat the interior of the mold cavity and the interior of the metal flanges 18 and 20 so that a liner 120 is formed having a uniform thickness. The liner 120 is adhered to the interior of the flanges 18 and 20. The smooth blending of the inside surface of the mold 110 into the plane of the tapered foot 18*b* provides a smooth, continuous surface.

Referring now to FIG. 5, a completed pressure vessel 10 is provided by machining away a plug portion 124 of the liner 120 to form an access opening 126. The side wall of the liner 120 is helically wound with epoxy-impregnated filaments 128 to provide reinforcement for longitudinal and hoop stresses.

Access openings are provided through the cover plate 14 to accommodate inlet and outlet piping 24 and 26, respectively, and for a pressure relief valve 28. It maybe noted that the outlet 26 extends upwardly in the pressure vessel to prevent air from being trapped in the tank. A number of additional access openings 30 are provided in the cover plate 16 to accommodate sensing equipment and heating elements (not shown).

Figure 8:
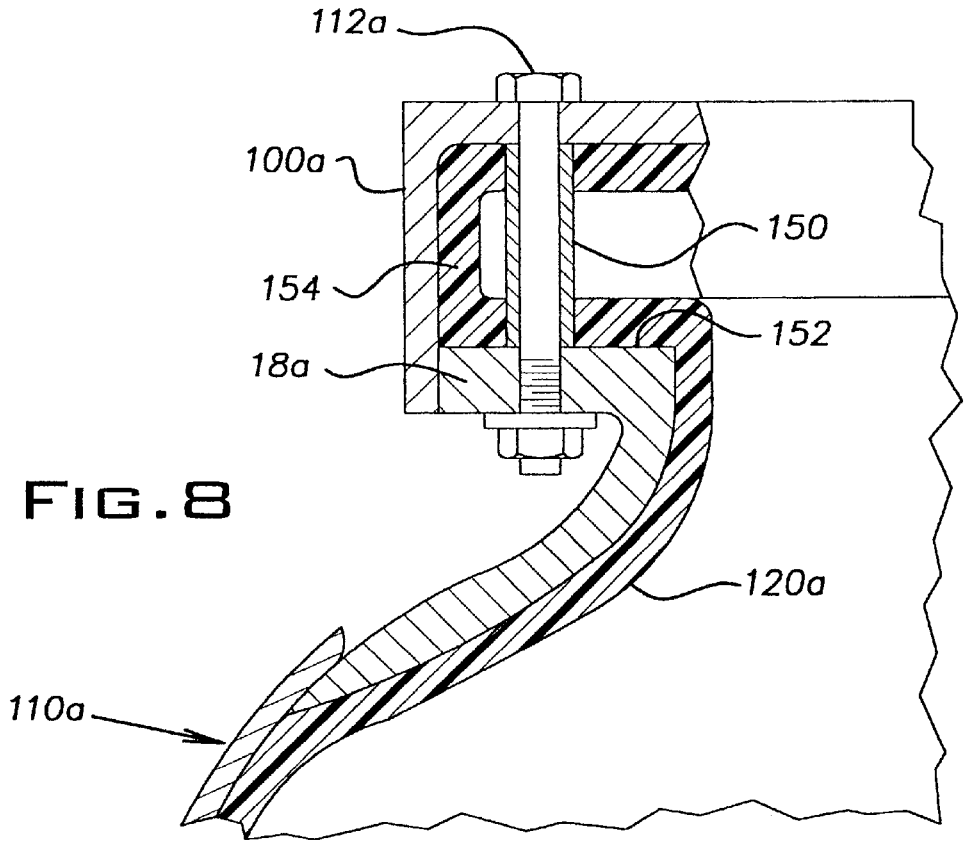
FIG. 8 is a fragmentary elevational view, partly in section, of a rotational casting mounting arrangement for producing an inner plastic pressure vessel according to another aspect of this invention.
Figure 9:
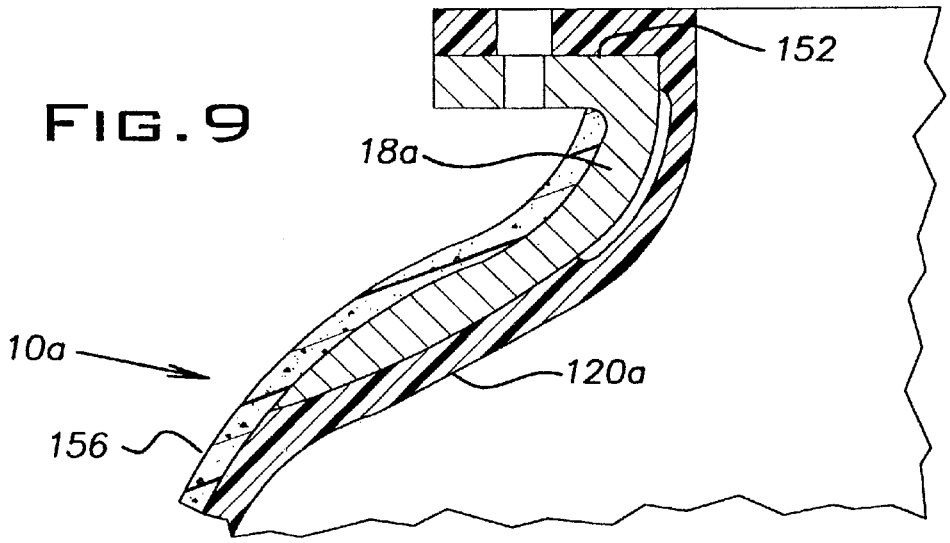
FIG. 9 is a fragmentary elevational view of a pressure vessel according to a further aspect of this invention.

Referring now to FIGS. 8 and 9 there is illustrated an alternate embodiment of the pressure vessel 10 wherein the liner 120*a* covers the upper face of the flange 18*a* to prevent liquid contained in the pressure vessel from contacting any portion of the metal flange 18*a*. To that end, a rotational casting mold 110 a is mounted between mounting plates 100*a* a by a plurality of bolts 112*a* which extend from the mounting plate 100*a* through the flange 18*a*. Spacers 150 are provided around the bolts 112*a*. During a rotational casting operation, a plastic liner 120*a* coats the inside surface of the mold 110*a* and the interior of the flange 18*a* including an upper surface portion 152 of the flange 18*a*.

After the liner 120*a* and its flange 18*a* are removed from the mold by removing the bolts 112*a* and the mounting plate 100*a*, a liner plug 154 is machined away to provide the structure illustrated in FIG. 9. The liner 120*a* is helically wound with resin impregnated filaments 156 to provide reinforcement for longitudinal and hoop stresses in the completed pressure vessel.

Figure 6:
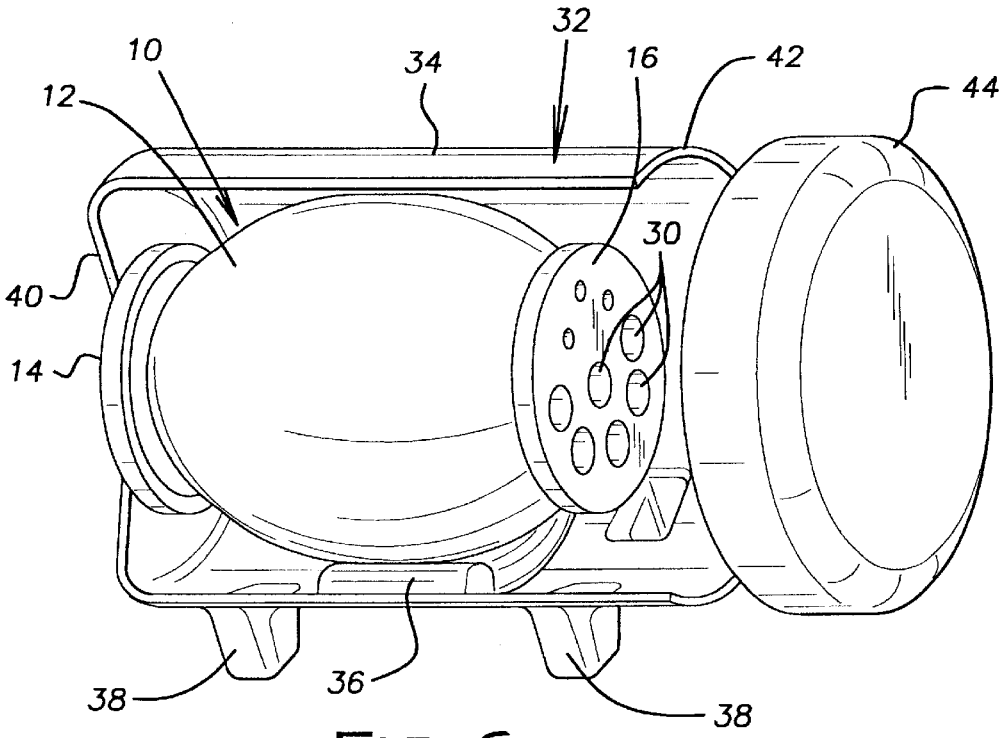
FIG. 6 is a perspective view of the pressure vessel mounted within an outer housing.
Figure 7:
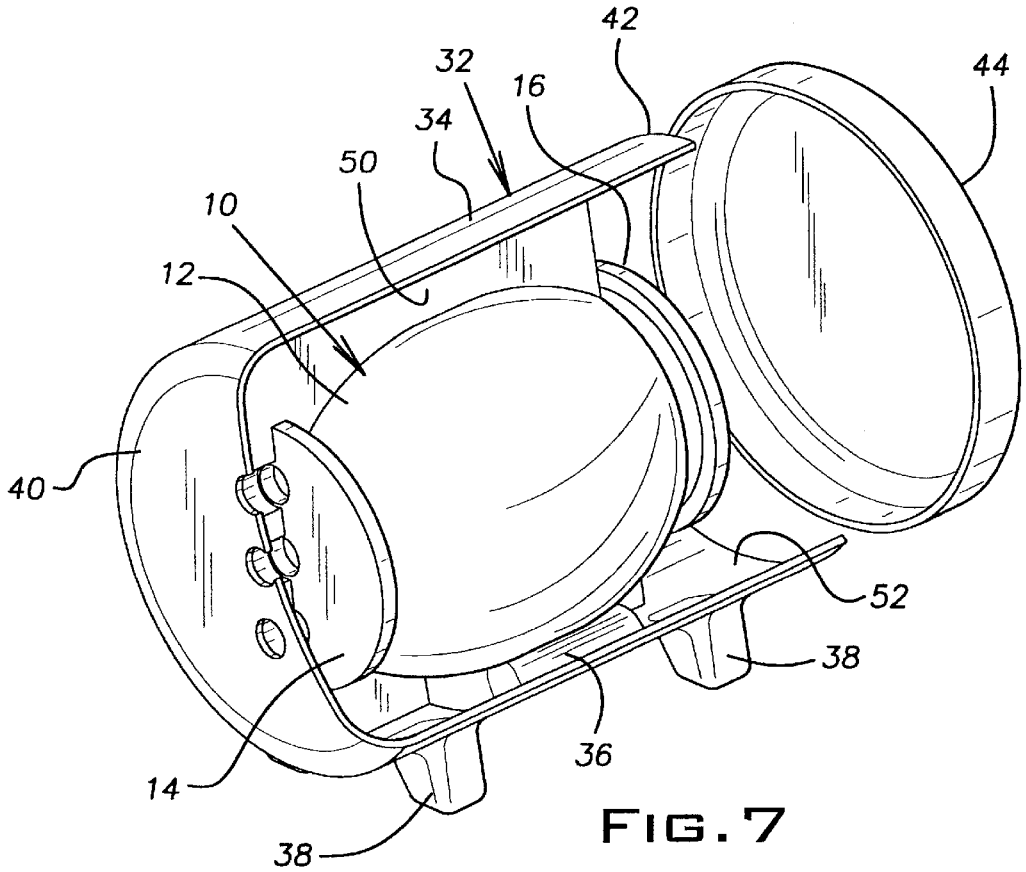
FIG. 7 is a view similar to a FIG. 6 but from a different perspective.

Referring now to FIGS. 6 and 7, the pressure vessel 10 is mounted within an outer plastic housing 32. The housing 32 is preferably rotationally cast and has a generally cylindrical sidewall 34 which defines a centrally located saddle 36 for mounting the pressure vessel in a horizonal position. The sidewall 34 also defines molded-in support legs 38. The outer plastic housing 32 has an end wall 40 and an open, opposite end 42 which is closed by a removable cap 44.

The saddle 36 mounts the pressure vessel 10 so that the pressure vessel 10 is substantially coaxially mounted in the outer plastic housing 32 and is spaced from the cylindrical sidewall of the housing. The cover plate 14, however, is positioned closely adjacent the bottom wall 40 while the cover plate 16 is spaced from the open end 42.

With the pressure vessel 10 mounted within the housing 32, a urethane foam insulation 50 (FIG. 7) is foamed in place through an aperture (not shown) in the outer housing 32. A suitable removable plug (not shown) is positioned in the open end 42 of the housing 32 in an abutting relationship to the cover plate to provide a space 52 between the cover plate 16 and the removable cap 44. The plug is removed after the urethane 50 is foamed in place. Access may then be had to the interior of the inner plastic pressure vessel 10 for servicing by removal of the cover plate 16. Various controls (not shown) maybe provided in the space such as sensing equipment, heating elements, thermostatic switches and the like.

Although the preferred embodiment of this invention has been shown and described, it should be understood that various modifications and rearrangements of the parts may be resorted to without departing from the scope of the invention as disclosed and claimed herein.

What is claimed is:

1. An insulated composite hot water heater comprising an inner plastic pressure vessel for storing and heating water, said pressure vessel having a sidewall defining an access opening which is provided with a removable closure plate, a heat exchanger unit within said pressure vessel and retained therein by said closure plate, an outer housing surrounding said inner plastic pressure vessel, a thermal insulating material interposed between said sidewall of said vessel and said housing, and a removable closure cap on said housing and being axially spaced from said closure plate and said insulation material to define a chamber for mounting switching and thermostatic controls for said heat exchanger unit and permitting access to said cover plate.

2. An insulated composite pressure vessel according to claim 1 wherein said insulating material is foamed-in-place polyurethane.

3. An insulated composite hot water heater according to claim 1 wherein said heat exchanger unit is an electric resistance heater.

4. An insulated composite hot water heater according to claim 3 wherein said inner pressure vessel includes a plastic liner helically wound with epoxy-impregnated filaments.

5. An insulated hot water heater comprising an inner plastic pressure vessel for storing and heating water, said pressure vessel having a sidewall defining an access opening at one end thereof further defined by a flange having a cylindrical neck portion provided with a tapered foot, said pressure vessel comprising a plastic liner having a portion adhered to an interior of said cylindrical neck portion and said foot, a removable closure plate mounted on said flange, a heat exchanger unit within said pressure vessel and retained therein by said closure plate, an outer housing surrounding said inner plastic pressure vessel, a thermal insulating material interposed between said vessel and said housing, and a removable closure cap on said housing and being axially spaced from said closure plate and said insulation material to define a chamber for mounting switching and thermostatic controls for said heat exchanger unit and permitting access to said cover plate.

6. An insulated pressure vessel according to claim 5 wherein a second access opening is provided at another end of said pressure vessel, said second access opening having a second removable closure plate mounted thereon, said second removable cover plate having inlet and outlet piping passing therethrough.

7. An insulated composite pressure vessel according to claim 6 wherein said insulating material is foamed-in-place polyurethane.

8. An insulated composite hot water heater according to claim 7 wherein said heat exchanger unit is an electric resistance heater.

9. An insulated composite hot water heater according to claim 8 wherein said inner pressure vessel includes a plastic liner helically wound with epoxy-impregnated filaments.

* * * * *